United States Patent [19]

Paschen et al.

[11] Patent Number: 5,041,836

[45] Date of Patent: Aug. 20, 1991

[54] SELF-STEERED ANTENNA SYSTEM

[75] Inventors: Dean A. Paschen, Lafayette; T. H. Taylor, Jr., Louisville, both of Colo.

[73] Assignee: Ball Corporation, Muncie, Ind.

[21] Appl. No.: 538,144

[22] Filed: Jun. 14, 1990

[51] Int. Cl.[5] ..... H01Q 3/30

[52] U.S. Cl. ..... 342/375; 342/102; 342/89; 342/189; 342/378

[58] Field of Search ..... 342/375, 89, 102, 59, 342/378, 189

[56] References Cited

U.S. PATENT DOCUMENTS

| | | | |
|---|---|---|---|
| 4,189,733 | 2/1980 | Malm | 342/368 |
| 4,544,927 | 10/1985 | Kurth et al. | 342/373 |
| 4,652,879 | 3/1987 | Rudish et al. | 342/371 |
| 4,724,439 | 2/1988 | Wiley et al. | 342/351 |
| 4,725,844 | 2/1988 | Goodwin et al. | 342/374 |
| 4,772,893 | 9/1988 | Iwasaki | 342/374 X |
| 4,882,589 | 11/1989 | Reisenfeld | 342/374 |
| 4,924,234 | 5/1990 | Thompson | 342/369 |

*Primary Examiner*—John B. Sotomayor
*Attorney, Agent, or Firm*—Gilbert E. Alberding

[57] ABSTRACT

An antenna system determines the true time delay in two or more correlated signals without a priori knowledge of the time relationship between the signals and uses the determined true time relationship to achieve maximum signal combinations of received and/or transmitted signals, increased receive G/T and/or transmit EIRP. The antenna system can provide adaptive beam steering with optimal time delays for each antenna element of a phased array and can combine distinct antenna apertures to create a larger effective antenna aperture.

16 Claims, 3 Drawing Sheets

SELF-STEERED ANTENNA SYSTEM

TECHNICAL FIELD

This invention relates to an antenna system adapted to determine true time delay and to combine signals in true time, and to methods and apparatus for determining true time delay between two or more signals in adaptive time delay equalization systems.

BACKGROUND ART

Steerable beam antenna system typically consist of two basic types—reflector antennas and phased arrays. Although other antennas, such as lens antennas, are used, the reflector and phased array antenna approaches are by far the two most common. Some basic problems, however, exist with each of these antenna systems.

Reflector antennas are simple and well understood and make up the majority of high gain antenna systems. In order to steer a reflector antenna, a mechanical movement of the entire reflector is usually necessary; however, alternatives such as mechanical or electrical displacement of the feed have also been used. The speed at which the beam can be steered is limited by the mechanical limitations on accelerating the mass of the reflector or other movable parts of the antenna. The mechanical precision of the movement mechanism also limits the pointing accuracy of the antenna beam. The structure which supports the reflector surface must provide a certain precision to maximize the gain of the reflector. Surface deformation considerations also cause the structural requirements to increase significantly as the size of the antenna increases.

Phased array antennas have some advantages over reflector antennas. First, since the beam is steered electronically, the speed of beam motion is considerably faster than for a reflector antenna, especially for large regions of coverage. Pattern shaping and beam control is more straight forward and can easily be changed with the same order of speed as the beam motion. Phased arrays are usually flat and thus require considerably less depth for installation than a reflector antenna. Phased array antennas also have several disadvantages over reflector antennas. They are typically much more expensive. The efficiency of large phased array antennas is typically much lower, unless active amplifiers are distributed throughout the array, increasing the cost still further. The gain of a phased array antenna decreases as the beam is steered off broadside while a reflector antenna has constant gain if mechanically steered by motion of the entire antenna.

There have been many prior methods and apparatus for steerable beam antenna systems intended to enhance the signal, improve signal to noise ratios, measure direction and frequency and improve the resolution of such measurements and the like. Such prior methods and apparatus used with phased arrays antenna systems include, for example, those disclosed in U.S. Pat. Nos. 4,189,733; 4,544,927; and 4,652,879.

DISCLOSURE OF THE INVENTION

The invention provides an antenna system that operates by determining the true time delay in two or more signals and by combining two or more signals with the determined true time delay.

The invention provides, for example, a method and apparatus for combining distinct antenna apertures to create a larger effective antenna aperture. The invention uses adaptive steering which allows the system to determine the best phase and/or time delay to apply to each antenna element of the system in order to achieve the maximum signal combination possible. The invention improves previously developed self-steered phased arrays by using two or more phase detection channels which are capable of narrow bandwidth steering in order to determine the time delay required to steer the antenna elements of the system in a broadband manner. This improvement is necessary in systems which receive broadband signals and/or for systems which require transmit operation at frequencies adjacent to the receive band frequencies. The adaptive steering helps to compensate for errors in the position of the elements, the pointing direction, the path length from the target to the elements (including atmospheric effects), and the position of the target.

The invention can be used generally to determine the proper time delay between two correlated signals without a priori knowledge of the time relationship between the two signals.

The invention can maximize the benefits of both reflector and phased array antenna systems while minimizing the negative aspects of these two standard approaches. The invention provides a means of combining existing antennas to increase the receive G/T and/or transmit EIRP of a satellite ground station antenna system. An automatic combiner apparatus of the invention will allow users to use existing ground station antenna systems in combination for higher data rates, mobile satellite control stations, etc.

The invention also provides a method and apparatus of performing target search and acquisition in the most efficient manner possible. A typical target search with a narrow beam, high gain antenna is accomplished by scanning the beam in a predetermined pattern. The probability of intercepting the target may be very low for short duration signals. This invention provides a method and apparatus for automatically focusing the antenna beam at the signal to provide continuous coverage of a large area with a high gain antenna.

A primary object of this invention is, therefore, to provide a method and apparatus for determining the time delay difference between two or more correlated signals without any a priori knowledge of the time relationship between the signals. One benefit of true time delay information is that a two element interferometer can be built with high resolution; the ambiguity positional information, which is typically eliminated by providing spatial diversity with several antenna elements between the two outermost antenna elements, can be now eliminated using spectral diversity in the signals themselves.

A second object of this invention is to provide an intermediate system which lies between reflector and phased array approaches and which offers significant benefits for some applications. This invention compensates in a real time manner for uncertainties in position of elements, electrical path length, and motion of the antenna elements or the target object at the other end of the link. The motion compensation for the target object is in essence an auto tracking technique; and the compensated time delay (or phase) at three or more elements in a standard phased array with a known element spacing can also be used to set the remaining phases and/or time delay values without duplication of the method and apparatus for each individual element.

Other features and advantages will be apparent from the drawings and detailed description of the invention that follow.

BEST MODE FOR CARRYING OUT THE INVENTION

The invention uses a method of combining two or more antenna inputs such that the signals are combined in true time delay. The exact implementation of this method can vary, but the unique aspect is the use of two or more separate narrow band phase detectors to determine the correct time delay to optimally combine separate antenna elements or apertures.

Figure 1:
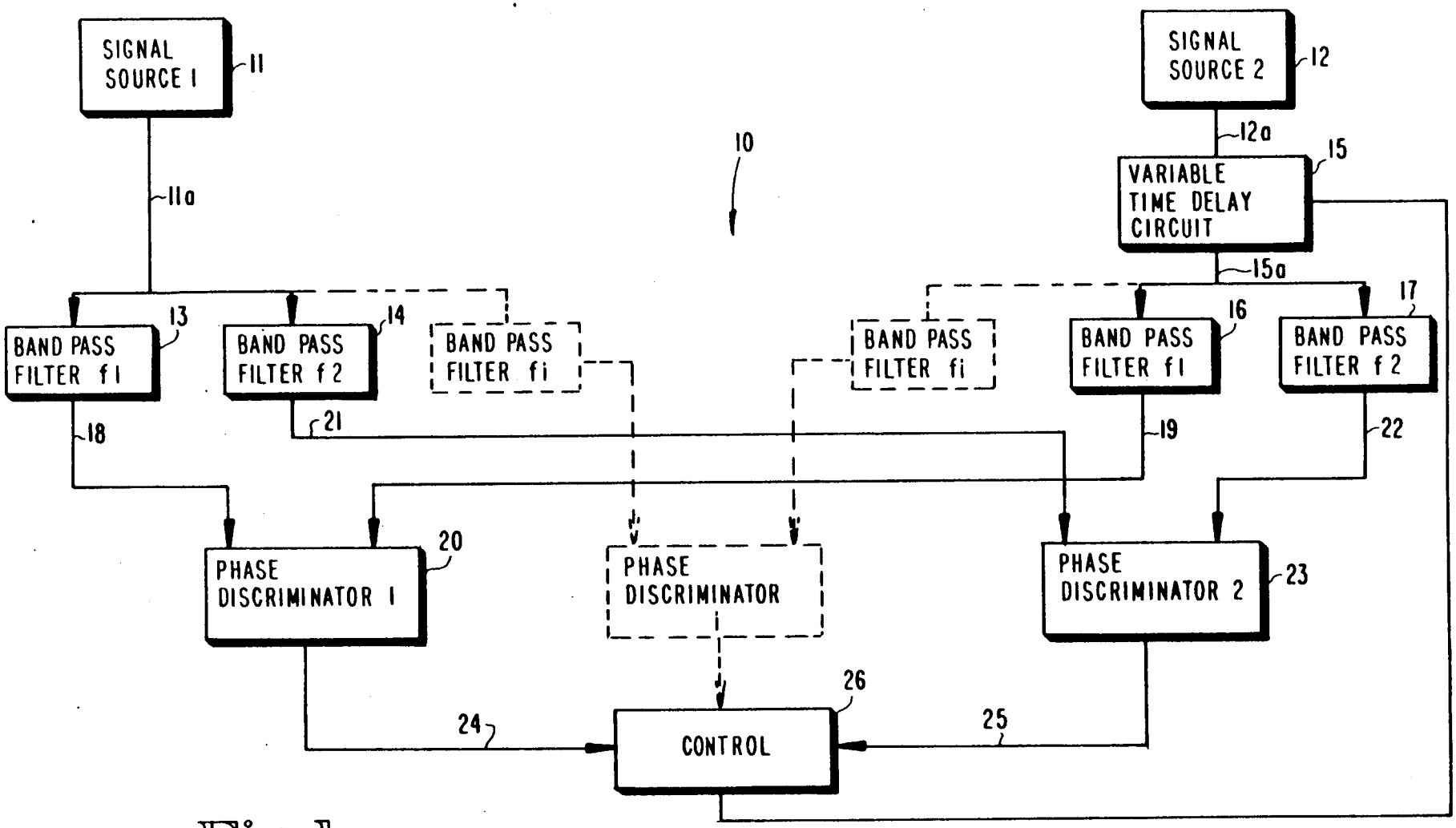
FIG. 1 is a block diagram of a basic system of the invention.

FIG. 1 is a block diagram of a basic system 10 of the invention. The system 10 operates on a first signal 11*a* from a first signal source 11, for example, a first antenna element and a second signal 12*a* from a second signal source 12, for example, a second antenna element.

The first and second signals are each connected with at least two narrow bandpass filters. As shown in FIG. 1, the first signal is connected with a first bandpass filter 13 having an output $f_1$ and a second bandpass filter 14 having an output $f_2$. As indicated by the dashed lines, the first signal 11*a* may be connected with one or a plurality of additional bandpass filters for the reasons set forth below. In the system shown in FIG. 1, the second signal passes through a variable time delay circuit 15 between the second signal source and the bandpass filters. As explained further below, the variable time delay circuit may be and is controlled to impose a time delay on the second signal 11*a* and can provide an adjusted second signal 15*a*. The second signal 12*a*, or adjusted second signal 15*a*, is connected with a third bandpass filter 16 (which, like the first bandpass filter 13, has an output $f_1$) and a fourth bandpass filter 17 (which, like the second bandpass filter 14, has an output $f_2$). The second signal 12*a*, or adjusted second signal 15*a*, may also be connected to one or a plurality of additional bandpass filters as indicated in dashed lines in FIG. 1.

As shown in FIG. 1, the $f_1$ output 18 and the $f_1$ output 19 of the first and third bandpass filters 13 and 16, respectively, are connected to a first phase discriminator 20 and form a first phase discrimination channel for the $f_1$ outputs of the first signal 11*a* and second signal 12*a*, or adjusted second signal 15*a* when time delay is imposed by the variable time delay circuit 15. In addition, the $f_2$ output 21 of the second bandpass filter 14 and the $f_2$ output 22 of the fourth bandpass filter 17 are connected to a second phase discriminator 23 and form a second phase discrimination channel for the $f_2$ outputs of the first signal 11*a* and the second signal 12*a* or adjusted second signal 15*a* when time delay is imposed by the variable time delay circuit 15. If the first and second signals are connected with additional bandpass filters to provide additional $f_i$ outputs of the first and second signals, the additional $f_i$ outputs of the additional bandpass filters are connected to additional phase discriminators, as shown in dashed lines in FIG. 1, to form parallel additional phase discrimination channels.

As shown in FIG. 1, the output 24 of the first phase discriminator 20 (which represents a first phase difference $\phi_1$ between the $f_1$ outputs of the first signal 11*a* and second signal 12*a*, or adjusted second signal 15*a* if time is imposed by circuit 15) and the output 25 of the second phase discriminator 23 (which represents a second phase difference $\phi_2$ between $f_2$ outputs of the first signal 11*a* and second signal 12*a*, or adjusted second signal 15*a* if time delay is imposed by circuit 15) are connected to a control 26, which processes the outputs 24 and 25 of the first and second phase discriminators and operates system 10 to remove ambiguity represented by the inability of a single phase discriminator to identify a multiple number of full cycles of phase difference between two signals and determine the true time difference between the first signal 11*a* and second signal 12*a*. As shown below, the invention can be extended to include a plurality of more than two signal sources or antenna elements, and can, in an antenna system, be used to adjust received signals from a plurality of antenna elements in true time to be coincident at a receiver or be used to adjust the times of transmitted signals from a plurality of antenna elements so that they are directed at a target object in phase.

Figure 2:
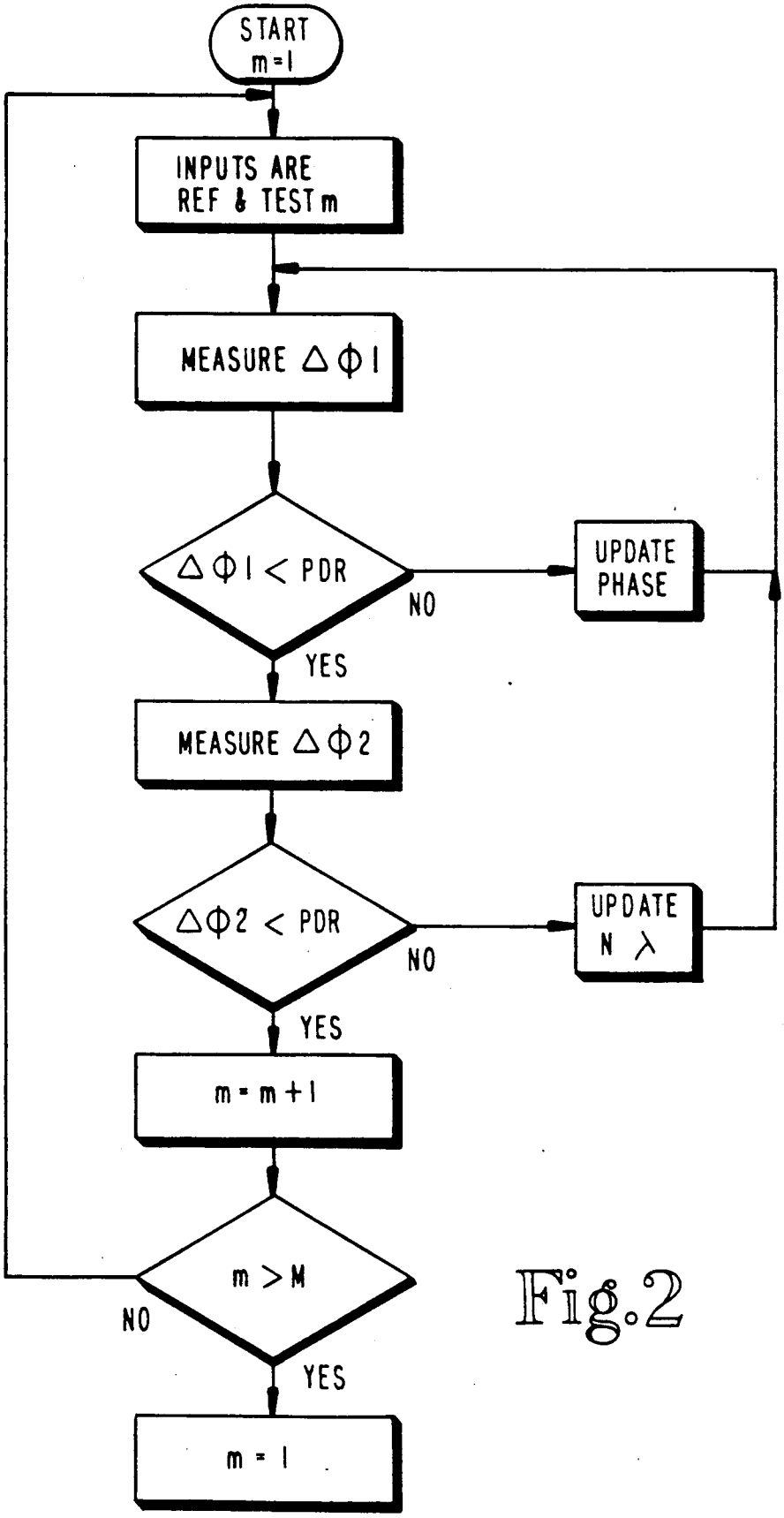
FIG. 2 is a flow chart of an adaptive method of the invention.

The system 10 includes the use of a method illustrated by the flow diagram shown in FIG. 2 in the control 26. The $f_1$ output of the first signal 11*a* from bandpass filter 13 (or reference input) is compared in phase with the $f_1$ output of the second signal 12*a* from the third bandpass filter 16 (or test input) using phase detector 20. The output 24 ($\phi_1$) of the phase detector is used to update the time delay network 15 in phase only (i.e., time delay which is less than one wavelength at the operating frequency). Thereafter, an adjusted second signal 15*a* differs from the first signal 11*a* by an integral number of cycles. The second channel, which includes the $f_2$ bandpass filters 14, 17 and the second phase detector 23 and is offset in frequency to the first channel, is then used to determine the phase difference ($\phi_2$) between the $f_2$ output of the first signal 11*a* and the $f_2$ output of the adjusted second signal 15*a*. The phase error ($\phi_2$) in the second channel will be proportional to the frequency ratio of the two channels ($f_2/f_1$) times the number of wavelengths of time delay error at the first channel operating frequency (the first channel has been aligned in phase but may be in error by an integral number of wavelengths). The residual phase difference $\phi_2$, at the second channel is given by $$\phi_2 = \frac{f_2}{f_1} N\, 360^\circ \tag{1}$$

where N is the number of integer wavelengths of time delay error at the operating frequency ($f_1$) and $f_2$ is the frequency of the second channel. The ability of the technique to determine time delay errors is a function of the ratio of the two frequencies $f_1$ and $f_2$ and the phase detector resolution, as shown by examination of the phase difference $\phi$ between the phase at $f_2$ and the phase at $f_1$. This phase difference is given by $$\phi = \phi_2 - \phi_1 = \frac{f_2}{f_1} N\, 360^\circ \tag{2}$$

-continued $$\Delta\phi = N\,360^\circ\left[\frac{f_2}{f_1} - 1\right], \text{ or } \frac{\Delta\phi}{N} = 360\left[\frac{f_2}{f_1} - 1\right] \quad (3)$$

The quantity $\Delta\phi/N$ is the phase shift at frequency $f_2$ per wavelength of time delay error at frequency $f_1$. This quantity is defined as the phase step ($\phi_{step}$). For maximum sensitivity, the phase detector resolution (PDR) should be set to be slightly better than this value $$PDR \leqq \phi_{step} = 360^\circ\left[\frac{f_2}{f_1} - 1\right] \quad (4)$$

Then a single wavelength of time delay error can be detected. The maximum time delay error which can be detected with the two channel network is determined by the ambiguity in the phase detector when the phase error exceeds ±180 degrees. If the maximum unambiguous phase of ±(180−PDR) is substituted for $\phi$ in equation 3 then $$N_{maximum} = \frac{180^\circ - PDR}{\phi_{step}} \quad (5)$$

where $N_{maximum}$ is the nearest integer rounded zero. If the quantity $N_{maximum}$ is not large enough for proper operation, additional frequencies can be used, as shown in dashed lines in FIG. 1. Since the value $\phi_{step}$ can be decreased by choosing channel monitoring frequencies closer to $f_1$, the $N_{maximum}$ can be increased arbitrarily. Limitations may be based on the availability of receiver signals at the desired frequencies; in many cases, the choice of $f_2$ is restricted by the existing system receiver spectrum.

Figure 3:
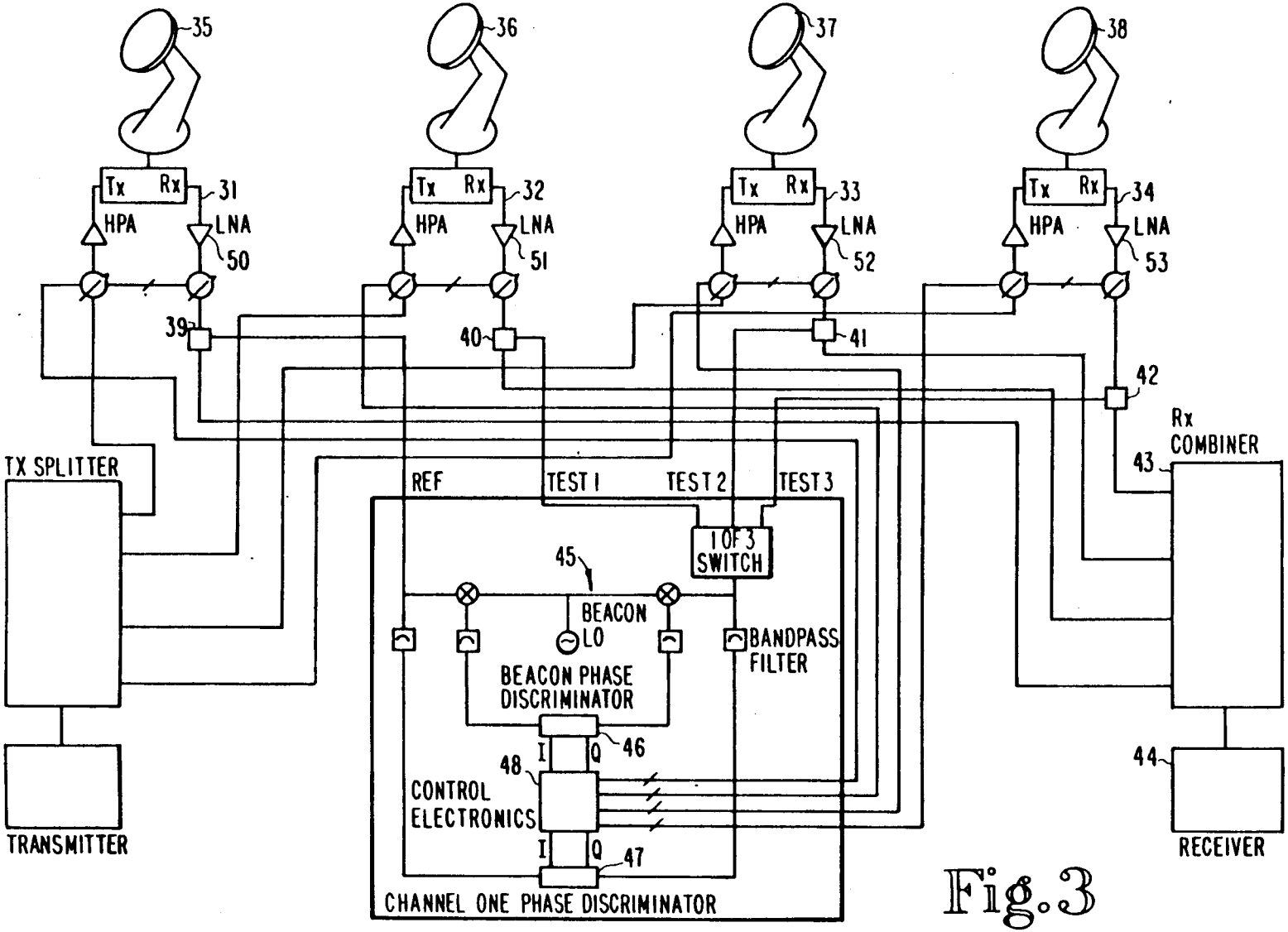
FIG. 3 is a diagrammatic drawing of an antenna system of the invention.

An implementation of this invention is shown in FIG. 3. This configuration uses the Defense Satellite Communications System (DSCS) frequency allocations. In this example, four inputs 31, 32, 33, 34 from four separate antennas 35, 36, 37, 38 can be combined in true time delay so that the gain on both receive and transmit is increased by a factor of four (the G/T increases by 6 dB and the EIRP by 12 dB over a single aperture with identical amplifiers).

The frequencies chosen are Channel One from 7.25-7.31 GHz and one of the beacon frequencies either 7.590 or 7.615 GHz. This arrangement provides a of about 15 degrees, and a $N_{maximum}$ of 11 wavelength at the Channel One band. These frequencies were chosen for the benefit of continuous availability of the receive signal. The uncertainty in the absolute position of the four elements must be within ±18 inches in order to stay within the ±11 wavelength range of unambiguous time delay error for which the system can compensate.

If time delay uncertainties greater than ±11 wavelengths are present, the use of both beacon frequencies and an additional phase discrimination channel would allow a resolution of additional time delay error without ambiguity. Every 11.75 wavelengths of error at the first beacon frequency cause the phase detector to change by 180 degrees; however, the same error at the second beacon frequency changes by an additional 14 degrees. This phase error at the second beacon frequency allows over ±140 wavelengths to be measured before both detectors become ambiguous simultaneously. Additional phase discrimination channels can provide even greater time delay extremes to be unambiguously determined. However, in practice the time delay may be known to some coarse increment, and the apparatus can provide the additional resolution to align the signals. The operation of the ±11 wavelength implementation is described below.

The REFERENCE channel input 31 and TEST1 channel input 32 are aligned first. The received input signals 31, 32 (and 33, 34) travel through the diplexers, low noise amplifiers (LNAs), and receiver time delay networks which are preset to the middle of the total time delay range. Couplers 39, 40, 41, 42 are used to sample the channels prior to the four way combiner 43 which feeds the receiver 44. A separate down converter 45 is used for the beacon frequency since it is desirable to filter and phase detect at a lower frequency for this narrow bandwidth signal. A phase discriminator, quadrature mixer, or similar circuit which provides a voltage proportional to the sine and cosine of the angle between two signals can be used as the phase detectors 46, 47. This provides higher resolution than a single cosine function phase detector; since both cosine and sine information is available, the phase can be aligned by achieving a zero output at the sine (Q) port of the phase discriminator. The outputs of the phase discriminators 46, 47 are low pass filtered to capture a nearly DC output and separate it from the other undesired frequency components which are present. The discriminator outputs are connected with the control electronics 48.

The outputs of the Channel One phase discriminator 47 are used to align the phase of the time delay network on the TEST1 circuit, which may be located in the output of the low noise amplifier 51. The outputs of the beacon phase discriminator 46 are then used to set the integer wavelength value. A final phase adjustment is used to compensate for any phase error which is induced to the change of the integer wavelength values in the time delay network.

The TEST2 input 33 is selected and the process is repeated. After alignment of the third input 34, TEST3, the system returns to TEST1 to compensate for errors which may have appeared due to motion of the antenna, movement of the target object, or wavefront distortion. The process continually updates the time delay and phase so that the maximum system gain is always available.

Transmitter operation may be adjusted in the FIG. 3 system by the use of identical time delay networks in each transmitter network, (for example, at the input of the high power amplifier) which operate in parallel with the settings determined during the phase alignment process in the receiver networks. In other configurations the same delay network could be used for both transmitter and receiver operation.

This method and apparatus may be used for compensation of phase or time delay variation in components such as high power amplifiers. The technique when used in this fashion becomes an adaptive time delay equalization system.

Phase alignment is possible at very low input signal levels. This is due to the very narrow bandwidth information which results at the output of the phase detectors. Since the S/N at the phase detector outputs is several orders of magnitude higher than the actual information content of the signals, this technique can be used to align several antenna apertures which are well below detectable levels into a single channel with sufficient S/N for accurate demodulation. This is a necessary condition for use in systems where the individual antenna apertures are very small relative to the combined aperture.

The invention provides advantages over the prior practice of using single reflectors or phased arrays. Some of the advantages compared to a single reflector are:

Reduced mechanical pointing accuracy requirements;

Flexible deployment of the total aperture;

Distributed mechanical structure and wind loading;

Graceful degradation; and

Spatial combination of transmitter power.

Some of the advantages relative to phased arrays are:

Lower complexity;

Compensation for errors in position of elements; and

Gain which is virtually independent of scan angle.

The advantages over both a reflector and phased array are

Compensation for wavefront distortion such as atmospheric scintillation from nuclear striation;

Compensation for errors in pointing direction; and

Inherent automatic tracking.

As will be apparent to those skilled in the art, the invention may be implemented with many phase comparator circuits or phase detectors and with a variety of electronic component arrangements, and the invention is limited only by the prior art and the scope of the following claims.

We claim:

1. An antenna system, comprising:

a first antenna element providing a first antenna signal;

a second antenna element providing a second antenna signal;

a variable time delay circuit connected to provide an adjustable second antenna signal;

a first phase discriminator channel connected with said first antenna signal and said second antenna signal, said first phase discriminator channel comprising first means for providing first frequency components $f_1$ of said first and second antenna signals and a first phase discriminator to determine the first phase difference $\phi_1$ of said first frequency components of said first and second antenna signals;

a second phase discriminator channel connected with said first antenna signal and said second antenna signal, said second phase discriminator channel comprising second means for providing second frequency components $f_2$ of said first and second antenna signals and a second phase discriminator to determine the phase difference $\phi_2$ of said second frequency components of said first and second antenna signals;

an electronic control connected with said first and second phase discriminators and with said variable time delay circuit, said electronic control first determining the first phase difference $\phi_1$ of the first phase discriminator and adjusting the variable time delay circuit by a time to eliminate the component of the first phase difference $\phi_1$ less than one cycle, said time delay circuit thereafter providing an adjusted second antenna signal to said second means to provide second frequency components whereby the phase difference between the first frequency components of said first antenna signal and said adjusted second antenna signal equals an integral number of cycles:

said electronic control then determining from the second difference $\phi_2$ of the second phase discriminator the phase difference between the second frequency components of said first antenna signal and the adjusted second antenna signal, determining the integral number of cycles of phase difference between said first antenna signal and said second antenna signal and adjusting therefrom the variable time delay circuit by a time equal to the integral number of cycles of phase difference between said first antenna signal and said second antenna signal to provide a further adjusted second antenna signal in true time phase with said first antenna signal.

2. The antenna system of claim 1 wherein said first means for providing first frequency components of said first and second antenna signals comprises a plurality of narrow bandpass filters and said second means for providing second frequency components of said first and second antenna signals comprises a second plurality of bandpass filters.

3. The antenna system of claim 2 wherein one of the plurality of bandpass filters of said first means and one of the plurality of bandpass filters of said second means provide the first frequency component $f_1$ of said first and second antenna signals and adjusted second antenna signals, and wherein another of the plurality of bandpass filters of said first means and another of the bandpass filters of said second means provide the second frequency component $f_2$ of said first and second antenna signals and adjusted second antenna signals.

4. The antenna system of claim 3 where $f_2$ nearly equals $f_1$.

5. The antenna system of claim 1 further comprising at least one additional phase discriminator channel comprising a further plurality of narrow bandpass filters to provide an additional frequency component $f_i$ of said first and second antenna signals and adjusted second antenna signals and a further phase discriminator to determine the phase difference $\phi_i$ of said additional frequency components of said first and second antenna signals.

6. The antenna system of claim 1 wherein a variable time delay circuit is connected between a transmitter and said second antenna element to adjust the time of the signal transmitted from said second antenna element with respect to the time of the signal transmitted from said first antenna element.

7. The antenna system of claim 1 wherein said variable time delay circuit is connected between a receiver and said second antenna element to adjust the signal between said second antenna element and said receiver to coincide with the signal between said first antenna element and said receiver.

8. A method of determining true time delay between a first frequency signal and a second frequency signal, comprising:

producing first component signals of said first frequency signal and said second frequency signal at a first frequency $f_1$;

producing second component signals of said first frequency signal and said second frequency signal at a second frequency $f_2$;

determining the phase difference $\phi_1$ between said first component signals of said first frequency signal and said second frequency signal at said first frequency;

delaying said second frequency signal to eliminate the portion of the phase difference $\phi_1$ that is less than one cycle to provide an adjusted second frequency signal;

determining the phase difference $\phi_2$ between the second component signals of said first frequency signal and said adjusted second frequency signal at said second frequency $f_2$; and determining the portion of the phase difference $\phi_1$ that is greater than one cycle to provide, with the portion of the phase difference that is less than one cycle, the true time difference between the first frequency signal and second frequency signal.

9. The method of claim 8 wherein the first frequency $f_1$ and second frequency $f_2$ are selected to be nearly equal.

10. The method of claim 8 comprising:

producing at least third component signals of said first frequency signal and said second frequency signal at a further frequency $f_i$;

determining the phase difference $\phi_i$ between said at least third component signals of said first frequency signal and said second frequency signal; and using the phase difference $\phi_i$ to determine the portion of the phase difference $\phi_1$ that is greater than one cycle.

11. The method of claim 8 wherein said first component signals of said first and said second frequency signals are generated by passing said first and second frequency signals through narrow bandpass filters having an output $f_1$, and said second component signals of said first and second frequency signals are generated by passing said first and second frequency signals through narrow bandpass filters having an output $f_2$.

12. The method of claim 8 in the operation of a phased array antenna system wherein said first frequency signal is from a first antenna element and said second frequency signal is from a second antenna element, and the true time difference is used to insert a time delay in one of said first and second antenna signals to provide coincidence of said first and second antenna signals at a receiver.

13. The method of claim 8 in the operation of a phased array antenna system having a plurality of transmitting antennas wherein said true time difference is used to insert time delay in the signals transmitted from at least one of the plurality of transmitting antennas.

14. An antenna system capable of combining a plurality of antenna signals in true time, comprising:

a first antenna element providing a first antenna signal;

a second antenna element providing a second antenna signal;

a first phase discriminator connected with said first antenna signal and said second antenna signal and providing a first phase output of the phase difference between said first antenna signal and said second antenna signal;

means connected with said first antenna signal and said second antenna signal for providing first output signal at a known frequency ratio of said first antenna signal and a second output signal at said known frequency ratio of said second antenna signal;

a second phase discriminator connected with said first and second outputs of said means and providing a second phase output of the phase difference between said first and second outputs of said means;

a variable time delay circuit connected to adjust the second antenna signal; and an electronic control connected with said first and second phase discriminators and with said variable time delay circuit, said electronic control first determining from the first phase output of the first phase discriminator the phase difference $\phi_1$ between the first antenna signal and the second antenna signal and adjusting therefrom the variable time delay circuit by a time equal to the phase difference $\phi_1$ less the one cycle, said time delay circuit thereafter providing an adjusted second antenna signal to said first phase discriminator and said means whereby the phase difference between said first antenna signal and said adjusted second antenna signal equals an integral number of cycles;

said electronic control then determining from the second phase output of the second phase discriminator the phase difference between the first output of said means at the known frequency ratio of the first antenna signal and the second output of said means at the known frequency ratio of the adjusted second antenna signal, determining the integral number of cycles of phase difference between said first antenna signal and said second antenna signal and adjusting therefrom the variable time delay circuit by a time equal to the integral number of cycles of phase difference between said first antenna signal and said second antenna signal to provide a further adjusted second antenna signal in true time phase with said first antenna signal.

15. The antenna system of claim 1 wherein said first phase discriminator and said second phase discriminator have a phase detector resolution greater than or equal to the phase angle equal to the difference between the known frequency ratio of said frequency conversion means less one times 360.

16. The antenna system of claim 1 wherein said known frequency ratio is close to one.

* * * * *